US006192741B1

(12) United States Patent
Haataja et al.

(10) Patent No.: US 6,192,741 B1
(45) Date of Patent: Feb. 27, 2001

(54) SYSTEM FOR SLED-TRACK TESTING OF EXPLOSIVE MISSILES

(75) Inventors: M. Shannon Haataja, Huntsville; Kirby A. Holtam, Harvest; Thomas H. Kress, Gurley, all of AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 09/389,627

(22) Filed: Sep. 3, 1999

(51) Int. Cl.[7] ..... G01N 33/22
(52) U.S. Cl. ..... 73/35.15; 73/12.01
(58) Field of Search ..... 73/35.14, 35.15, 73/35.17, 12.01, 11.01

(56) References Cited

U.S. PATENT DOCUMENTS 4,007,688 * 2/1977 Franz ..... 102/378
4,014,262 * 3/1977 Betts ..... 102/335
4,934,268 * 6/1990 Levin ..... 102/220
5,050,683 * 9/1991 Sayles ..... 169/46

FOREIGN PATENT DOCUMENTS 5 77792 * 3/1991 (JP) .

* cited by examiner

*Primary Examiner*—Max Noori
(74) *Attorney, Agent, or Firm*—Arthur H. Tischer; Freddie M. Bush; Hay Kyung Chang

(57) ABSTRACT

In the improved system for sled-track testing of explosive missiles having tandem warheads and crush switches, time delay boards are placed on the sled to operate in conjunction with the crush switches to detonate the tip charge and the main warhead. The actual detonation is triggered by on-board firesets, one to detonate each warhead, that are optically coupled through an opto-coupler interface board which generates fire pulses in response to inputs received from the crush switch and the time delay board. These fire pulses are, in turn, transmitted to and activate the firesets.

4 Claims, 3 Drawing Sheets

SYSTEM FOR SLED-TRACK TESTING OF EXPLOSIVE MISSILES

DEDICATORY CLAUSE

The invention described herein may be manufactured, used and licensed by or for the Government for governmental purposes without the payment to us of any royalties thereon.

BACKGROUND OF THE INVENTION

Current sled-track testing of missiles that have tip charges and crush switches, such as TOW-2A missiles, requires that off-board (i.e. Off-sled) electronic and mechanical equipment be used to detonate the warheads. Since the equipment used to detonate and time the warheads does not ride on the sled with the warhead, crush switch signals and delayed fire pulses from the missile electronics cannot be easily used to trigger the capacitive discharge units that fire the warheads. To detonate the warheads, special test equipment off-board is used to sense the sled's position with respect to target impact and activate the warheads when the sled reaches a pre-selected relative position. The timing for detonation of tandem warheads is also determined by off-board counters and timers. While this method produces adquate results for determining warhead effectiveness against the target, it does not account for variations in the performances of the crush switch and the time delay board (for tandem warheads) which can have significant effects on the warhead penetration of the target on the battlefield.

SUMMARY OF THE INVENTION

The improved system for sled-track testing of explosive missiles allows the use of the crush switch and the time delay board that are mounted to the sled along with the opto-coupler interface board, fire sets and battery housing. The actual detonation is performed by two on-board firesets, one to detonate each warhead, that are optically coupled through opto-coupler which isolates the time delay board signals from the fire sets. Fire pulses are generated from the crush switch and time delay board. These fire pulses are, in turn, transmitted to and activate the firesets, ultimately resulting in the detonation of the warheads in a manner that is closer to their performance on the battlefield and thereby yielding data that is more descriptive of their capabilities.

DESCRIPTION OF THE PREFERRED EMBODIMENT

Figure 1:
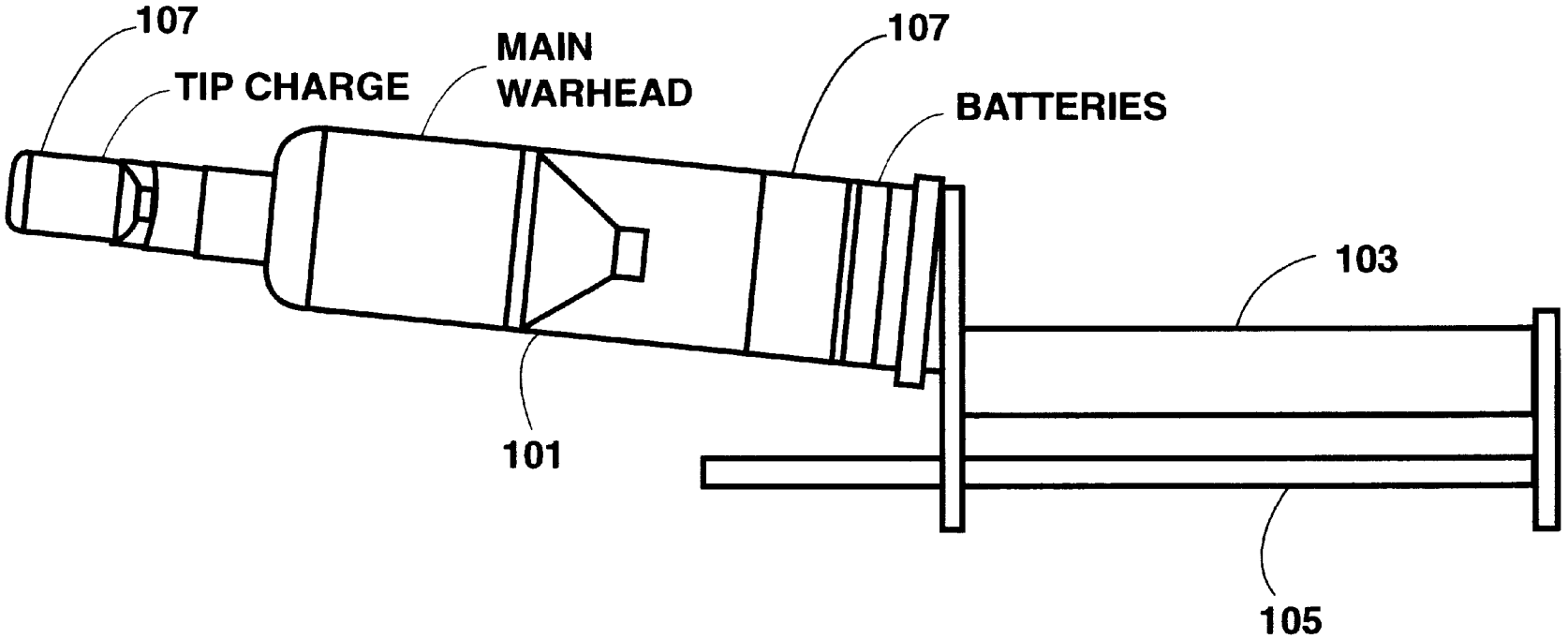
FIG. 1 presents a side view of the missile mounted on the sled for the improved sled-track testing.
Figure 2:
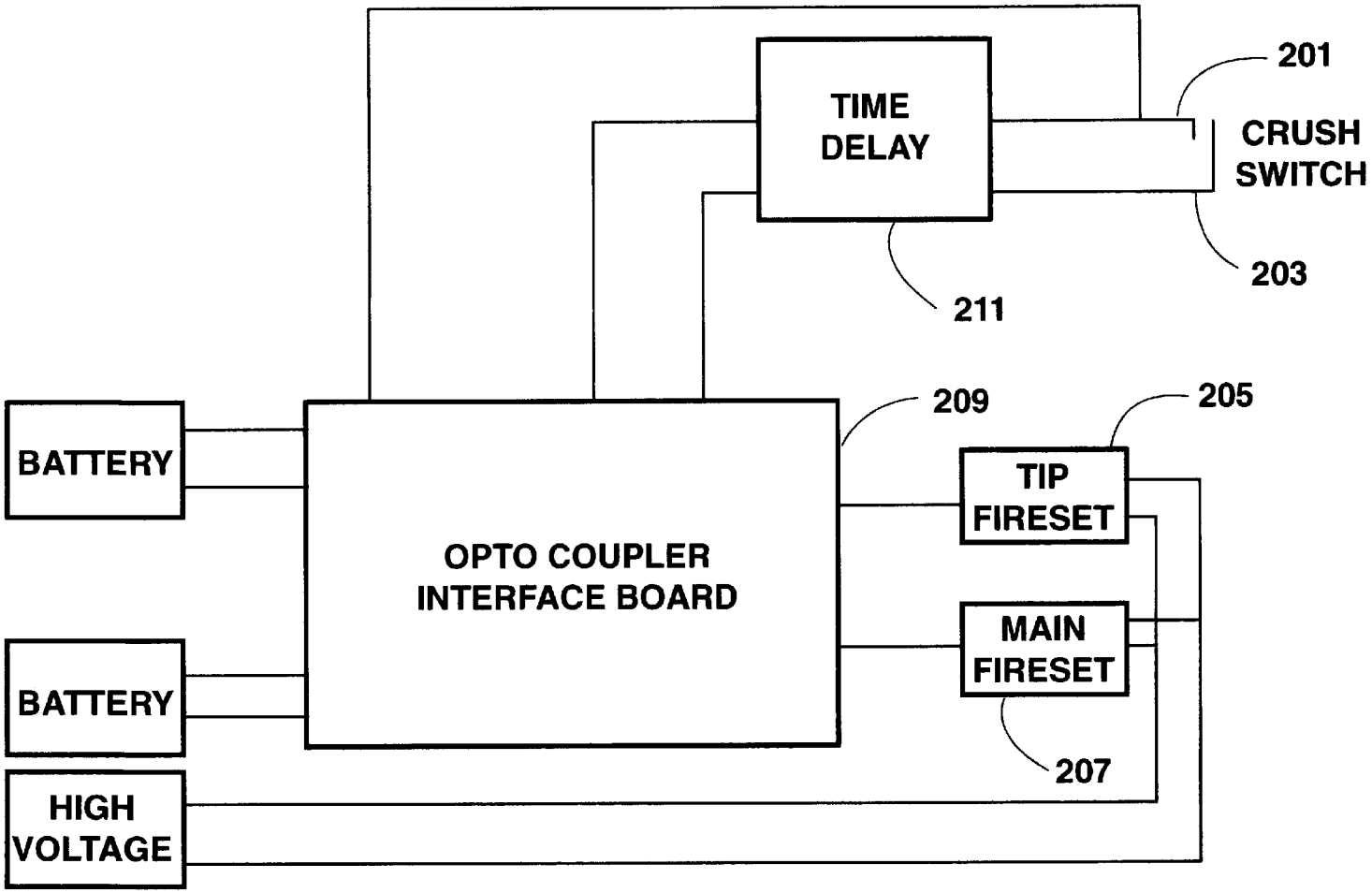
FIG. 2 is a diagram of the on-board electronics of the improved sled-track testing system.

Referring now to the drawing wherein like numbers represent like parts in each of the several figures, FIG. 1 shows how missile 101 that is to be subjected to the improved sled-track testing is mounted on sled 103. The sled itself is positioned on track (usually a monorail) 105, a portion of which is depicted in the figure, and is manipulated to rush at a certain speed toward a target (not shown) at one end of the track.

Prior to the commencement of the testing, a pair of screen boxes are placed on either side of the track at a pre-determined distance from the target, taking into consideration the speed at which the sled will be travelling down the track. High voltage is applied to the screen boxes from an off-board DC to DC converter. This is accomplished by the activation of a 28-V power supply in the converter. The converter then charges up a large bank of capacitors, approximately 20 $\mu$F, to a regulated 1700 volts. The voltage across the 20 $\mu$F capacitance is then placed across the two screen boxes of the pair via a high voltage cable, thereby "arming" the boxes. As the sled bearing the warheads rushes down the track, two conductive blades, each protruding from one side of the sled and long enough to reach the screen boxes, makes contact with the armed screen boxes. When the blades cut through the metallic screen of the boxes, tip fireset 205 which is coupled to one of the blades and main fireset 207 which is coupled to the other blade are charged by the 20 $\mu$F off-board capacitors. Due to energy transfer inefficiencies, the on-board firesets only charge to approximately 1500 volts rather than the full 1700 volts. The time to reach the 1500 volt charge is roughly 2 ms. The length of the screen boxes can be varied to ensure proper charging times based on the sled's predicted terminal velocity. Further, the screen boxes should be placed such that just after the sled blades leave the boxes the missile impacts the target. This ensures a full charge on both firesets and prevents a common ground between the two firesets.

Figure 3:
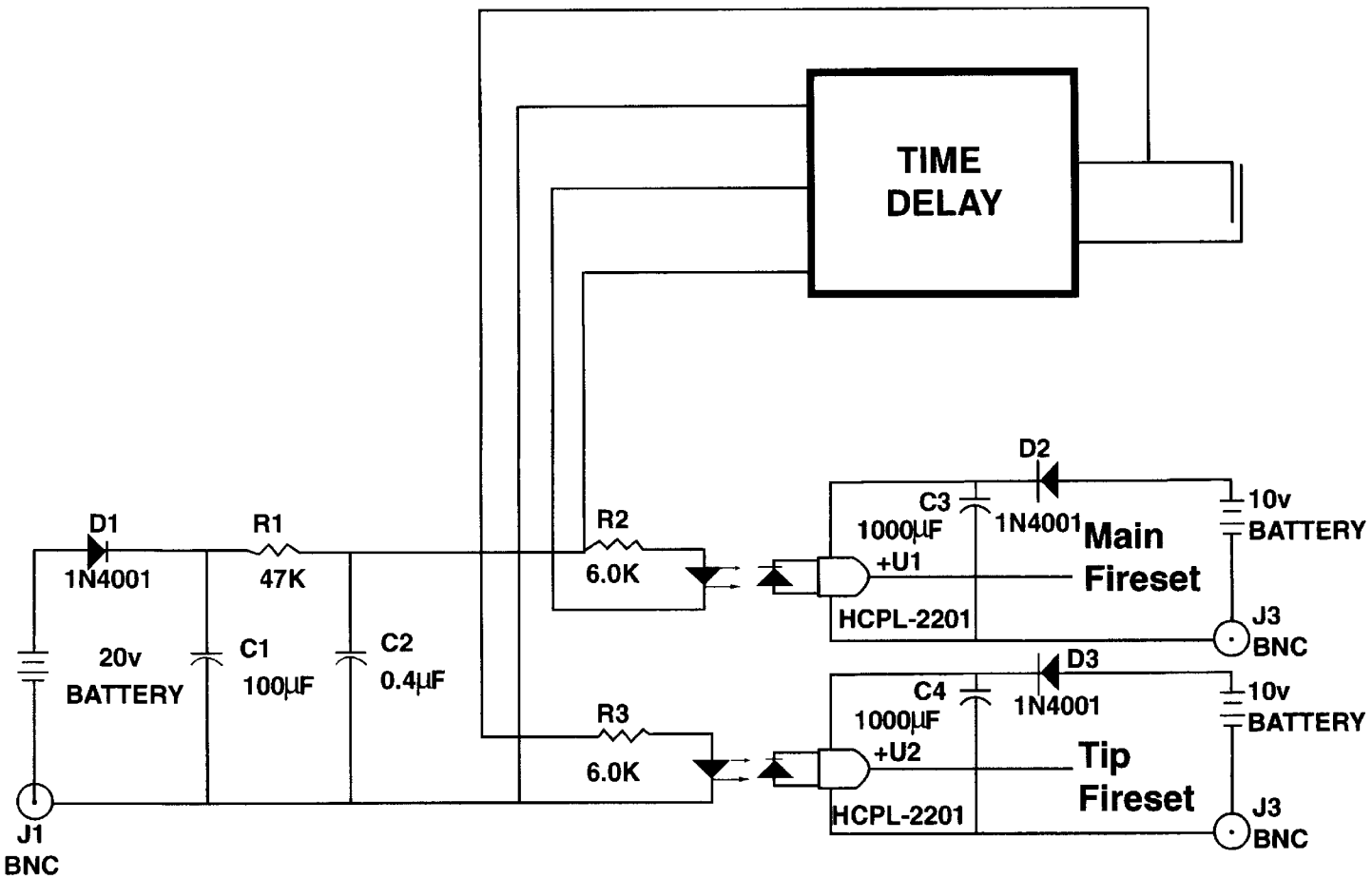
FIG. 3 illustrates one possible design of the opto-coupler.

Upon impact with the target, inner and outer gives 201 and 203, respectively, of crush switch 107 come together acting as a mechanical switch. This closure results in two things. First, a voltage is applied to one side of R3 of opto-coupler interface board 209 as detailed in FIG. 3 which application causes enough current to flow in the opto-coupler interface board to light the light emitting diode (LED) adjacent to R3. This LED produces a fire pulse that is input to tip charge fireset 205 which, in response, detonates the tip charge. Second, the closure of the crush switch ogives causes time delay board 211 to begin counting out a pre-set time interval. At the end of the interval, the output pulse from the time delay board transitions from a high to a low which applies a voltage across R2 and the LED adjacent to R2 of opto-coupler interface board 209 as detailed in FIG. 3. This causes sufficient current to flow through the opto-coupler interface board to produce another fire pulse which is input to main fireset 207, thereby detonating the main warhead.

On-board batteries are used to supply power to the various warhead electronics, including the opto-coupler interface board and time delay board. It is envisioned that three sets of batteries are used: one approximately 28-V set to power the crush switch, time delay board and a part of the opto-coupler board and two approximately 18-V sets to power the output sides of the opto-coupler board which produce the fire pulses. The on-board batteries, opto-coupler board and the firesets are placed in a suitable housing and potted to prevent them from sloshing around during the testing. The housing is then bolted into warhead adapter 107 that is coupled between the warhead and the sled.

The improved sled-track testing as described above utilizes crush switch and time delay board in forward ballistic sled track warhead testing and eliminates the need for large and costly off-board equipment for warhead timing and firing.

Although a particular embodiment and form of this invention has been illustrated, it is apparent that various modifications and embodiments of the invention may be made by those skilled in the art without departing from the scope and spirit of the foregoing disclosure. Accordingly, the scope of the invention should be limited only by the claims appended hereto.

We claim:

1. In a system for testing a missile intended for ultimate battlefield performance, the missile having a tip charge, a main warhead and a crush switch mounted onto the tip charge, the crush switch being connected to a power source and having an inner and an outer ogive that close together upon impact with a target, the testing system utilizing a sled having two opposing sides, the sled being adapted for carrying thereon the missile and being mounted on a track having an end and opposite sides, the sled being controllable to rush at a pre-selected speed toward a target located at one end of the track; a first pair and a second pair of screen boxes, one pair located on either side of the track; a means for powering the screen boxes; a first and a second conductive blade, one blade protruding from opposite sides of the sled and being long enough to make contact with the screen boxes at a pre-determined time; AN IMPROVEMENT for obtaining more accurate information of the missile performance, said IMPROVEMENT comprising: a first fireset for detonating the tip charge; a second fireset for detonating the main warhead; an opto-coupler interface board coupled to said first fireset and said second fireset; a time-delay circuit for counting a pre-set time interval, said time-delay circuit being coupled to said opto-coupler interface board and the crush switch and responding to the closure of the ogives by initiating said pre-set time count and outputting a voltage at the end of said pre-set time interval and transmitting said output voltage to said opto-coupler interface board, said opto-coupler interface board being further coupled to the crush switch and producing fire pulses in response to the closure of the ogives of the crush switch and said output voltage from said time-delay circuit, said fire pulses being input to said first and second firesets to cause the detonation of the tip charge and the main warhead, respectively, so as to enable the missile more closely to mimic its battlefield performance.

2. An IMPROVEMENT for testing a missile as set forth in claim 1, wherein said first and second firesets are coupled, respectively, to the first and second conductive blades and are powered when the blades make contact with the screen boxes.

3. An IMPROVEMENT for testing a missile as set forth in claim 2, wherein said IMPROVEMENT further comprises sufficient batteries to power said time-delay circuit and said opto-coupler interface board.

4. An IMPROVEMENT for testing a missile as set forth in claim 3, wherein said batteries, opto-coupler interface board and firesets are housed and potted in an adapter so as to be held securely in said adapter, said adapter being connected to the tip charge and the main warhead.

* * * * *